US005407178A

United States Patent [19]

Long

[11] Patent Number: 5,407,178

[45] Date of Patent: Apr. 18, 1995

[54] APPARATUS FOR SUSPENSION ACROSS A DRIVEWAY TO KEEP OBJECTS FROM ENTERING STREET

[76] Inventor: James Long, 7635 NW. Andrews, Lawton, Okla. 73505

[21] Appl. No.: 101,876

[22] Filed: Aug. 4, 1993

[51] Int. Cl.[6] ..... E04H 17/02

[52] U.S. Cl. ..... 256/45; 273/29 B; 160/354; 160/368.1

[58] Field of Search ..... 256/45, 47, 50; 160/351, 354, 368.1; 273/29 B, 29 BB, 29 BC

[56] References Cited

U.S. PATENT DOCUMENTS

| | | | |
|---|---|---|---|
| 843,326 | 2/1907 | Chapin . | |
| 1,680,548 | 8/1928 | Keiser . | |
| 2,465,936 | 3/1949 | Schultz | 160/368.1 |
| 3,273,862 | 9/1966 | Miller | 160/354 |
| 3,307,833 | 3/1967 | Müller et al. | 256/13.1 |
| 3,806,096 | 4/1974 | Eccleston et al. | 256/32 |
| 3,980,299 | 9/1976 | Brown | 273/29 R |
| 4,014,521 | 3/1977 | Berman | 256/1 |
| 4,153,246 | 5/1979 | Byrne | 273/26 A |
| 4,523,760 | 6/1985 | Bednarczuk | 273/29 B |
| 4,852,194 | 8/1989 | Langan | 5/427 |
| 4,971,319 | 11/1990 | Cutrone | 273/29 B |
| 5,048,844 | 9/1991 | Haseltine | 273/400 |
| 5,052,686 | 10/1991 | Pryor | 273/29 B |
| 5,067,273 | 11/1991 | Richwine | 47/33 |
| 5,186,438 | 2/1993 | Cross et al. | 256/13.1 |
| 5,271,449 | 12/1993 | Herrick | 160/354 |

FOREIGN PATENT DOCUMENTS

| | | | |
|---|---|---|---|
| 790905 | 2/1958 | United Kingdom | 160/351 |
| 1562025 | 3/1980 | United Kingdom | 273/29 BC |

*Primary Examiner*—Edward K. Look
*Assistant Examiner*—Mark Sgantzos
*Attorney, Agent, or Firm*—Dunlap & Codding

[57] ABSTRACT

A driveway guard for installation across a driveway to prevent playthings from going into the street. The driveway guard includes a pair of posts, a net with an apron, guy lines, tent pegs and assemblies for connecting the net to the posts. The net is long enough to span a two-car driveway and has a dividing strip separating the net into two net portions. One of the net portions has a length for spanning a one-car driveway. A pair of belts are attached to the dividing strip. To install the driveway guard across a two-car driveway, the entire length of the net is suspended across the driveway between the posts, which are staked and guyed into the ground on opposite sides of the driveway. The apron engages the driveway to prevent objects from rolling under the net into the street. For a one-car driveway, the net is rolled up from one end to the dividing strip and the belts are run around the roll and buckled. The one-car net portion is then suspended across the driveway. For storing and carrying the net, the net is rolled up from both ends to the dividing strip and the belts are buckled around the two rolls. A handle may be attached to the dividing strip to facilitate carrying the net.

9 Claims, 2 Drawing Sheets

APPARATUS FOR SUSPENSION ACROSS A DRIVEWAY TO KEEP OBJECTS FROM ENTERING STREET

BACKGROUND OF THE INVENTION

1. Field of the Invention

The present invention relates generally to a portable barrier for preventing objects from entering a restricted area, and particularly, but not by way of limitation, to a portable barrier set up across a driveway to prevent children's playthings from going into the street.

2. Description of Related Art

U.S. Pat. No. 4,852,194 issued to Langan discloses a safety barrier for small children. This barrier is designed for attachment to a porch railing to keep small children from crawling through the slats of the railing.

U.S. Pat. No. 5,186,438 issued to Cross et al. discloses a modular rock catchment barrier. This barrier includes a number of concrete bases which may be connected together. Fence panels are mounted on the concrete bases to provide a barrier to catch rocks from an excavation site.

A number of U.S. patents disclose barriers for use in sports, such as soccer and tennis. For example, U.S. Pat. No. 5,048,844 issued to Haseltine discloses a portable rebounding soccer training goal; U.S. Pat. No. 843,326 issued to Chapin discloses a tennis net; U.S. Pat. No. 3,980,299 issued to Brown discloses a tennis game apparatus kit; and U.S. Pat. No. 4,014,521 issued to Berman discloses a tennis court divider net with replaceable bottom panel.

This art does not address the safety of a child at play in a driveway. A child may run into the street to retrieve a toy at the risk of being struck by a vehicle. In order to provide a safer children's play area in a driveway, it is necessary to keep playthings from rolling or bouncing from the driveway into the street.

SUMMARY OF THE INVENTION

The present invention includes a pair of posts, a net with an apron, and a plurality of guy lines and tent stakes for retaining the posts in an upright position. The net is typically rectangular in shape and has a border extending therearound. The apron is attached to the lower border of the net. A corner grommet is provided in each corner of the border for attachment of the net to the posts.

A dividing strip extends between the upper and lower borders of the net at an intermediate point of the net. A pair of strap and buckle sets are attached to the dividing strip. An inner grommet is provided in the upper border and the lower border near the dividing strip.

One object of the present invention is to provide a portable net which may be suspended across a driveway to prevent playthings from going into the street.

Another object of the present invention is to provide a driveway guard which extends across a two-car driveway and may be shortened to the width of a one-car driveway.

Yet another object of the present invention is to provide a driveway guard which may be secured in a rolled-up fashion for storage when not in use.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
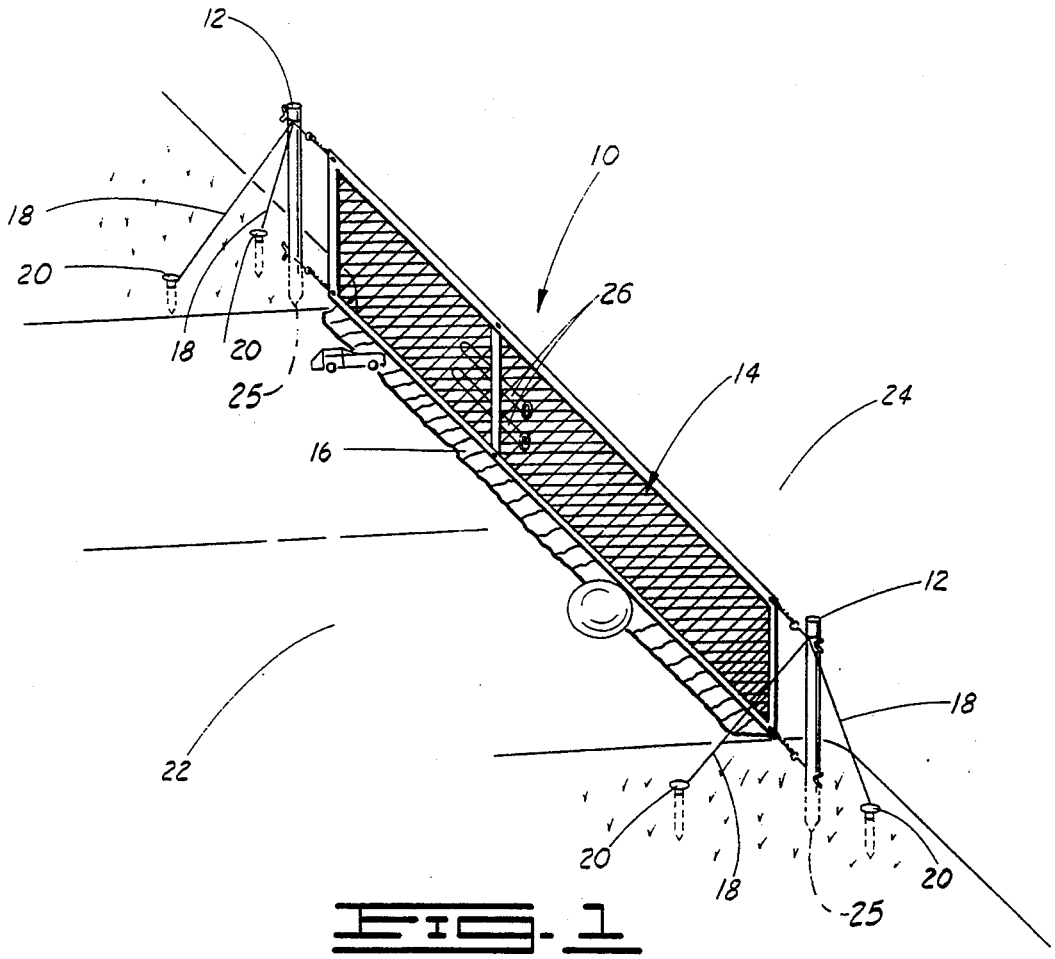
FIG. 1 is a perspective view of a driveway guard constructed in accordance with the present invention and installed across a two-car driveway.

Referring to the drawings in general, and to FIG. 1 in particular, shown therein and designated by the general reference numeral 10 is a driveway guard, which includes a pair of posts 12, a net 14 with an apron 16 and a plurality of guy lines 18 and tent pegs 20. The net 14 with apron 16 is suspended across a two-car driveway 22 between the posts 12 to prevent playthings, such as toy trucks and balls, on the driveway from going into the street 24.

The posts 12 are driven into the ground on opposite sides of the driveway 22. One end 25 of each post 12 may be pointed to facilitate the insertion of the post into the ground. The four corners of the net 14 are attached to the posts 12 to stretch the net 14 across the driveway 22. The apron 16 rests on the driveway 22 to prevent playthings from rolling under the net 14.

In order to retain the posts 12 in substantially upright positions, the guy lines 18 and tent pegs 20 are provided. Two of the guy lines 18 are attached to the upper end of each post 12, are drawn taut in divergent directions and are staked into the ground with tent pegs 20.

A pair of belts 26 are attached to one side of the net 14 to define a belt side and a beltless side of the net 14. The driveway guard 10 may be set up with either the belt side or the beltless side to the street 24. As illustrated by FIG. 1, the beltless side is typically faced toward the driveway 22 so that the belts 26 are not disposed in the play area of the driveway 22.

Figure 2:
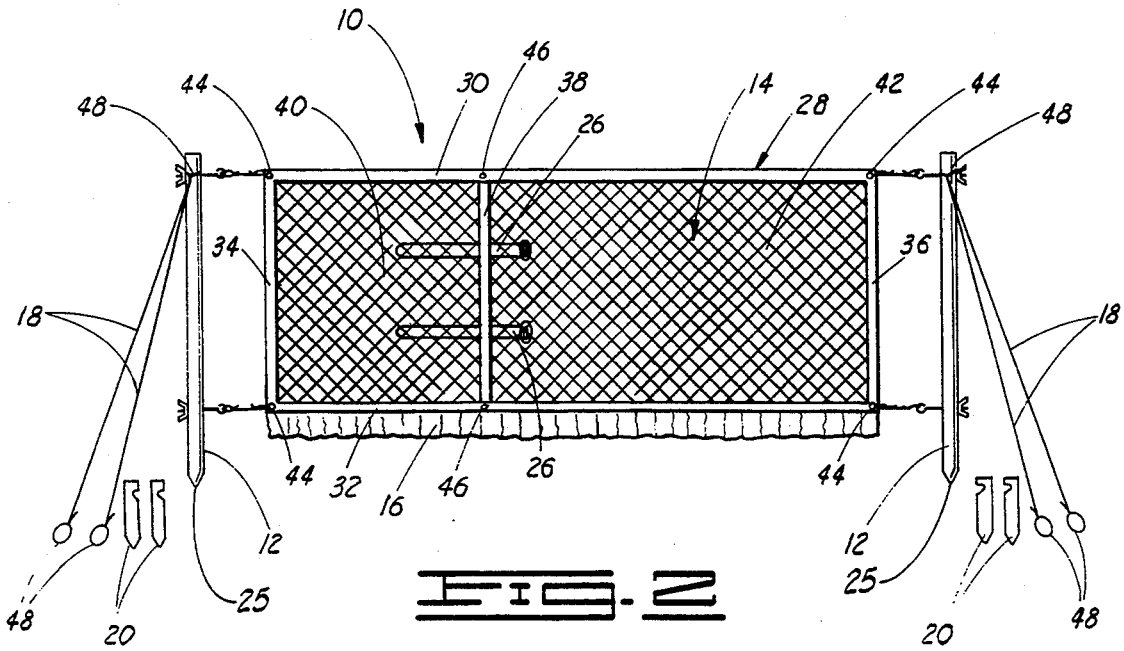
FIG. 2 is a front elevation of the driveway guard.

Referring now to FIG. 2, shown therein is the beltless side of the driveway guard 10. The net 14 is typically rectangular in shape with a substantially solid border 28 comprising an upper border 30, a lower border 32, a left side border 34 and a right side border 36.

The border 28 is typically made of a flexible polymeric material, such as polypropylene, but may be constructed of any suitable synthetic or natural substance. For example, the border 28 may be made of a woven fabric, such as canvas. The border 28 should be strong enough to support the web-like interior of the net 14 and be sufficiently flexible to be rolled up easily.

A dividing strip 38 extends between the upper border 30 and the lower border 32 at an intermediate point of the net 14. The dividing strip 38 may be made of the same material as the border 28. In order to span a two-car driveway 22, the net 14 has a length of approximately 27 feet. To shorten the net 14 to fit a one-car driveway, the dividing strip 38 is typically located about 10 feet from the left side border 34 of the net 14. Thus the dividing strip 38 separates the net 14 into two net portions 40 and 42.

A corner grommet 44 is located at each of the four corners of the border 28 of the net 14 to allow attachment of the net 14 to the posts 12. The corner grommets 44 may be made of any rigid plastic, metal or other suitable material.

In addition, an inner grommet 46 is provided through the upper border 30 and the lower border 32 of the net 14. As described in detail hereinafter, the inner grommets 46 are used to attach the net 14 to the posts 12 in a shortened configuration for spanning one-car driveways. Like the corner grommets 44, the inner grommets 46 may be plastic, metal or any other suitable material.

The apron 16 extends for the length of the net 14 from the lower border 32 of the net 14. The apron 16 may be constructed of any suitable fabric or flexible plastic material. The apron 16 should be flexible to bend and lie upon the driveway surface. The apron 16 should also be sufficiently solid to stop objects, such as toy vehicles and balls.

Each guy line 18 may have a loop 48 at both ends for securing the guy line 18 to the corresponding post 12 or tent peg 20. In attaching each guy line 18 to the posts 12, one loop 48 of the guy line 18 may simply be placed over the upper end of the post 12. The tension of the guy line 18 holds the loop 48 on the post 12 and the upper connecting assembly of the net 14 keeps the loop 48 from slipping down the post 12.

Figure 3:
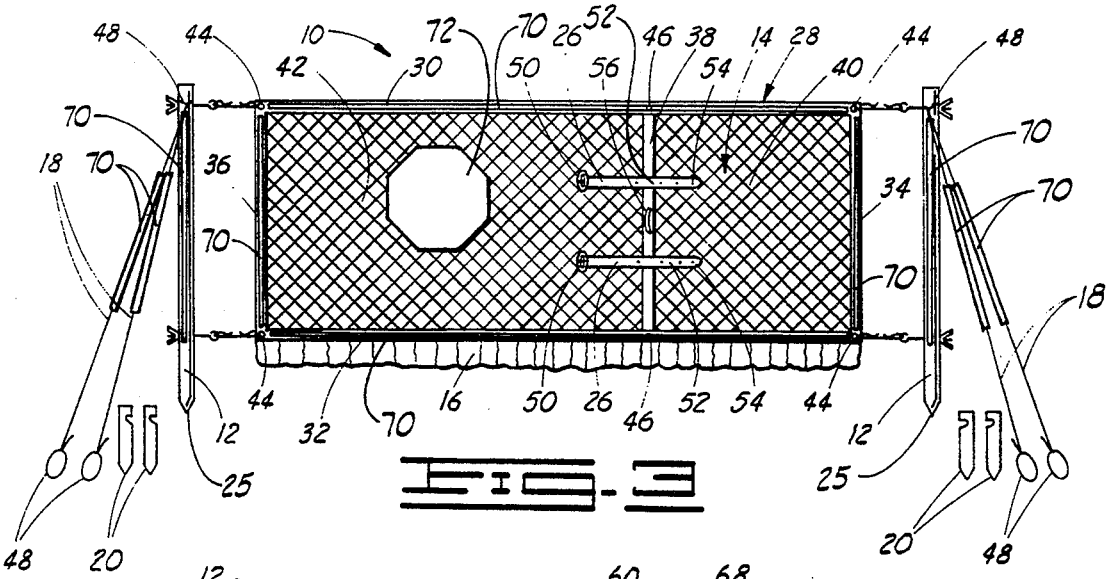
FIG. 3 is a rear elevation of the driveway guard.

With reference now to FIG. 3, shown therein is the belt side of the driveway guard 10. The belt side of the net 14 is like the beltless side, except that the pair of spaced apart belts 26 are attached to the dividing strip 38. Each belt 26 includes a belt buckle 50 at one end and a belt strap 52 having a plurality of belt holes therethrough for fastening each buckle 50 to any one of the belt holes through the corresponding strap 52. One of the belt holes through each belt strap 52 is designated by reference numeral 54 and is generally representative of the belt holes.

Each belt 26 is fastened to the dividing strip 38 at a medial point of its belt strap 52. The belt buckle 50 and the remainder of the belt strap 52 are unattached to the net 14.

The belt straps 52 may be fastened to the dividing strip 38 in any suitable manner. For example, the belt straps 52 may be sewn, glued or riveted to the dividing strip 38.

The belt straps 52 may be made of any suitable material, such as woven natural or synthetic fibers, cowhide, leather, canvas or polyurethane. The belt straps 52 should be long enough and sufficiently flexible to be wrapped around a rolled-up net 14. The belt holes 54 may be provided with eyelets to enhance the durability of the belt straps 52.

A handle 56 is attached to the dividing strip 38 between the two belts 26. The handle 56 may be made of any of the flexible materials which may be used for the belt straps 26, or the handle may be made of an inflexible material, such as metal, wood or hard plastic.

Figure 4:
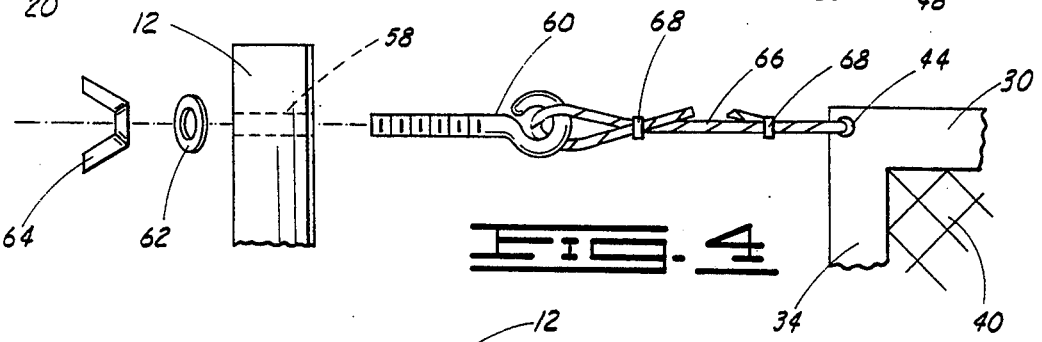
FIG. 4 is a partly exploded view of an upper corner portion of the driveway guard illustrating attachment of the net to one of the posts of the driveway guard.

Referring now to FIG. 4, shown therein is an assembly for connecting the net 14 to one of the posts 12. Each post 12 has a post bore 58 therethrough at each point where the net 14 is to be connected to the post 12. An eye-bolt 60 is inserted through each post bore 58 and is secured to the post 12 with a washer 62 and a wing nut 64.

One end of a rope 66 is passed through the eye of each eye-bolt 60 and the other end of the rope is passed through one of the grommets 44 of the net 14. A rope clamp 68 is affixed to the rope 66 to secure a loop of the rope 66 through the eye of the eye-bolt 60. Another rope clamp 68 is fastened to the rope 66 to secure an opposite loop of the rope 66 through the grommet 44 of the net 14.

The rope 66 may be made of any natural or synthetic fibers, such as hemp or nylon. The rope clamps 68 may be metal clamps which are squeezed onto the rope 66.

Any combination of the components of the driveway guard 10 may be luminescent or light reflective. For example, the net 14 and border 28 may be treated with phosphors to heighten the visibility of the driveway guard 10. As another example, any type of light-reflective strips 70 may be attached to the posts 12, the guy lines 18 and the street side of the net 14 to make the driveway guard 10 readily visible in the headlights of vehicles in the street 24.

In addition to being luminescent or light reflective for safety reasons, the driveway guard 10 may be brightly colored or include eye-catching, popular designs or cartoon characters. Such decorative features may be provided to enhance the attractiveness of the driveway guard 10 and to make the driveway guard 10 popular with children.

It should be appreciated that a variety of safety-oriented displays may be attached to the driveway guard 10 in view of motorists driving in the street 24. For example, a stop sign 72 facing into the street 24 may be mounted to the driveway guard 10. Signs reading "Caution," "Slow," "Children At Play" and the like may also be secured to the driveway guard 10 in view of passing motorists.

Installation Across a Two-Car Driveway

The installation of the driveway guard 10 across a two-car driveway is best understood with reference to FIG. 1. One end of a rope 66 is be run through each of the four corner grommets 44 of the net 14, looped back to the rope 66 and is clamped to the rope 66. The other end of each rope 66 is run through an eye of one of the eye-bolts 60 and clamped in a similar fashion.

With the net 14 laid out across the driveway 22, each eye-bolt 60 is inserted into a corresponding one of the post bores 58 and fastened with one of the washers 62 and wing nuts 64. The wing nuts 64 should be screwed onto the eye-bolts 60 to allow some of the threaded portion for later take-up.

One of the posts 12 is then inserted into the ground on one side of the driveway 22 and is secured with a pair of guy lines 18 and tent pegs 20. Typically the guy lines 18 are connected to the posts 12 by placing one loop 48 over the top of the post 12. The other loop 48 of each guy line 18 is staked down with one of the tent pegs 20.

The net 14 is stretched across the driveway 22 and the other post 12 is inserted into the ground on the opposite side of the driveway 22. The second post 12 is then guyed and staked.

If the net 12 is not taut enough, the wing nuts 64 may be screwed onto the eye-bolts 60 further to take up some slack. If the net 14 remains too slack, then one of the posts 12 may need to be relocated to provide proper tension in the net 14.

The net 14 should be secured well enough to withstand the force of a child's playthings being rolled, thrown, hit or kicked against it. Moreover, the apron 16 should be seated against the driveway 22 to prevent objects from passing between the net 14 and the driveway 22 into the street 24.

Installation Across a One-Car Driveway

Figure 5:
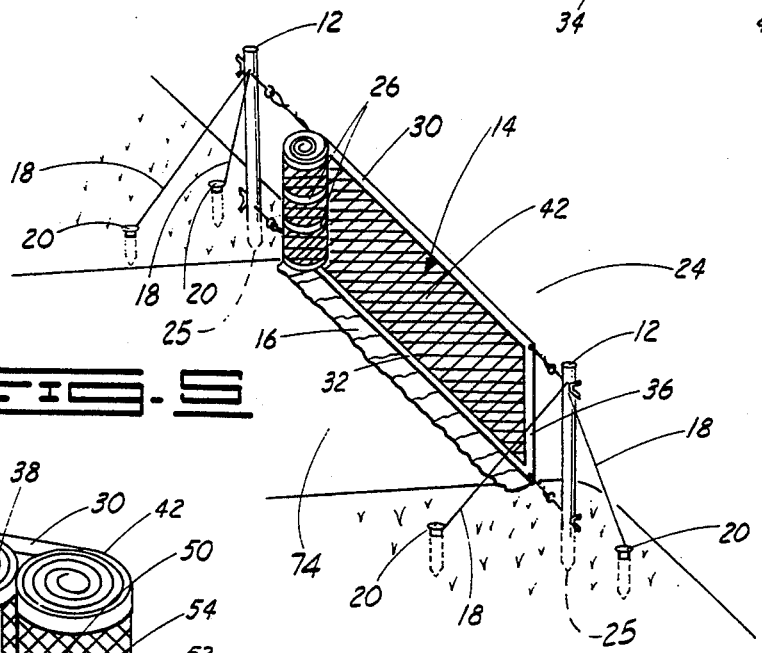
FIG. 5 is a perspective view of the driveway guard installed across a one-car driveway.

With reference now to FIG. 5, shown therein is the driveway guard 10 installed across a one-car driveway 74. As described hereinabove, net portion 42 has a length designed to span a one-car driveway, a length which is approximately 17 feet.

For set-up across a one-car driveway 74, the net portion 40 and the corner grommets 44 in side border 34 are not utilized. Instead, the inner grommets 46 are used to connect the net 14 to one of the posts 12.

Accordingly, net portion 40 is rolled up from its end to the dividing strip 38 with the belts 26 on the outside of the roll. Then the running ends of the belt straps 52 are inserted through the net 14, around the rolled-up net portion 40 and secured to the corresponding belt buckle 50. It should be appreciated that the dimensions of the belt straps 52 and the openings in the net 14 are such that the belt straps 52 may be inserted through the openings in the net 14.

With net portion 40 rolled up and secured, the inner grommets 46 of the net 14 are positioned for attachment to one of the posts 12. The connection assembly of the inner grommets 46 to the post 12 with ropes 66, rope clamps 68, eye-bolts 60, washers 62 and wing nuts 64 is the same as that described hereinabove for the corner grommets 44. In addition, the procedure for setting up the driveway guard 10 across a one-car driveway 74 is substantially identical to that described hereinabove for the two-car driveway 22.

Storage of the Driveway Guard

Figure 6:
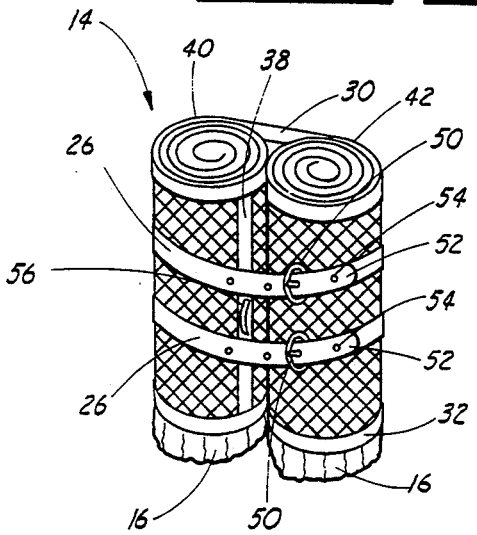
FIG. 6 is a perspective view of the driveway guard rolled up and secured for storage.

Referring now to FIG. 6, shown therein is the net 14 rolled up and secured for storage. Both net portions 40 and 42 are rolled up to the dividing strip 38 with the belts 26 on the outside of the rolls. Net portion 40 forms one roll and net portion 42 defines another roll.

The belt straps 52 are then brought around both rolls and secured to their corresponding buckles 50. Rolled up and secured in this manner, the net 14 is compact for storage and is easily carried by the handle 56. Furthermore, the net 14 is neatly stored and readily unrolled for its next installation across either a one-car or a two-car driveway.

Although the drawing figures show the driveway guard 10 installed across driveways next to the street, the driveway guard 10 may be located at any point along the length of a driveway. For example, it may be desirable to place the driveway guard 10 across a driveway far enough from the street 24 to allow a car to be parked in the driveway between the driveway guard 10 and the street 24.

It should be appreciated that the driveway guard 10 may be used in a wide variety of locations, many of which do not even involve a driveway. For example, the driveway guard 10 may be set up near a creek, lake or pond to keep objects from entering the water. The driveway guard 10 could also be installed in front of a muddy or overgrown area, a ravine or any dangerous area. A driveway guard 10 with suitable length could even be installed across a street which has been closed for construction, a block party, a parade or a carnival.

Changes may be made in the combinations, operations and arrangements of the various parts and elements described herein without departing from the spirit and scope of the invention as defined in the following claims.

What is claimed is:

1. An apparatus for preventing objects from entering a street from a driveway, the apparatus comprising:

a pair of posts, each post being removably secured in a substantially upright position on opposite sides of a driveway;

a net suspended across the driveway between said posts, said net having a lower end disposed toward the driveway;

an apron attached to the lower end of said net with at least a portion of said apron engaging the driveway to prevent objects from passing between the lower end of said net and the driveway; and means for enhancing the visibility of the apparatus.

2. The apparatus of claim 1 wherein said posts include a luminescent material.

3. The apparatus of claim 1 wherein said posts include a light-reflecting material.

4. The apparatus of claim 1 wherein said net includes a luminescent material.

5. The apparatus of claim 1 wherein said net includes a light-reflecting material.

6. The apparatus of claim 1 further comprising:

a plurality of guy lines attached to each post; and means for removably anchoring each one of said guy lines to the ground;

wherein said guy lines include a luminescent material.

7. The apparatus of claim 1 further comprising:

a plurality of guy lines attached to each post; and means for removably anchoring each one of said guy lines to the grounds;

wherein said guy lines include a light-reflecting material.

8. A method of preventing objects from entering a street from a one-car driveway, the steps of the method comprising:

providing a pair of posts and a net, the net having an overall length for spanning a two-car driveway and having a plurality of straps attached thereto such that the distance from one end of the net to the point of attachment of the straps is approximately equal to the width of a one-car driveway;

rolling up the net from the end thereof to the straps to form a rolled-up end of the net;

passing the straps through the net and around the rolled-up end of the net;

securing the straps around the rolled-up end of the net;

placing the posts on opposite sides of a one-car driveway in substantially upright positions; and attaching the rolled-up end of the net to one post and the opposite end of the net to the other post to suspend the net across the one-car driveway to prevent objects from entering the street from the one-car driveway.

9. The method of claim 8 further comprising the step of:

guying and anchoring the posts to maintain the posts in a substantially upright position.

* * * * *